US009871317B2

(12) United States Patent
Zhang et al.

(10) Patent No.: US 9,871,317 B2
(45) Date of Patent: Jan. 16, 2018

(54) WATERPROOF ELECTRICAL CONNECTOR

(71) Applicant: FOXCONN INTERCONNECT TECHNOLOGY LIMITED, Grand Cayman (KY)

(72) Inventors: Jian-Li Zhang, HuaiAn (CN); Jun Zhao, HuaiAn (CN); Jing-Jie Guo, HuaiAn (CN); Ling-Xiao Kong, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/361,509

(22) Filed: Nov. 28, 2016

(65) Prior Publication Data

US 2017/0155208 A1 Jun. 1, 2017

(30) Foreign Application Priority Data

Nov. 27, 2015 (CN) ..... 2015 1 0840299

(51) Int. Cl.

| | |
|---|---|
| ***H01R 13/6581*** | (2011.01) |
| ***H01R 13/52*** | (2006.01) |
| ***H01R 24/60*** | (2011.01) |
| ***H01R 13/648*** | (2006.01) |
| ***H01R 43/24*** | (2006.01) |
| *H01R 107/00* | (2006.01) |

(52) U.S. Cl.

CPC ..... *H01R 13/5216* (2013.01); *H01R 13/648* (2013.01); *H01R 24/60* (2013.01); *H01R 43/24* (2013.01); *H01R 2107/00* (2013.01)

(58) Field of Classification Search

CPC ..... H01R 13/6581
USPC ..... 439/589, 660, 936, 607.4, 736
See application file for complete search history.

(56) References Cited

U.S. PATENT DOCUMENTS

| | | | | |
|---|---|---|---|---|
| 5,593,320 | A * | 1/1997 | Konda | H01R 13/521 439/589 |
| 5,658,170 | A * | 8/1997 | Tan | H01R 9/034 439/607.41 |
| 7,717,717 | B1 * | 5/2010 | Lai | H01R 13/64 439/66 |
| 8,801,463 | B2 * | 8/2014 | Tan | H01R 13/5202 439/607.04 |
| 8,827,742 | B2 * | 9/2014 | Wang | H01R 24/68 439/569 |

(Continued)

FOREIGN PATENT DOCUMENTS

| | | |
|---|---|---|
| CN | 204118373 | 1/2015 |
| CN | 204167590 | 2/2015 |

*Primary Examiner* — Neil Abrams
(74) *Attorney, Agent, or Firm* — Wei Te Chung; Ming Chieh Chang

(57) ABSTRACT

An electrical connector includes an insulative housing, a number of terminals retained in the insulative housing, a shielding shell attached to the insulative housing, and an insulator insert-molded with a rear end of the shielding shell. The terminals have a number of soldering portions extending out of a rear surface of the insulative housing. The shielding shell has a tail portion located at a rear end thereof. The insulator at least wraps partly an external surface of the tail portion to seal up a rear end of the insulative housing and extend the soldering portions of the terminals through the insulator to expose a rear surface thereof.

20 Claims, 7 Drawing Sheets

(56) References Cited

U.S. PATENT DOCUMENTS

| | | | | |
|---|---|---|---|---|
| 9,033,739 | B2 * | 5/2015 | Sloey | H01R 13/5202 439/607.35 |
| 9,088,092 | B2 | 7/2015 | Kuo | |
| 9,197,004 | B2 * | 11/2015 | Kuo | H01R 13/521 |
| 9,276,365 | B2 * | 3/2016 | Yu | H01R 24/70 |
| 9,281,608 | B2 * | 3/2016 | Zhao | H01R 12/57 |
| 9,331,421 | B2 * | 5/2016 | Lai | H01R 13/5202 |
| 9,379,499 | B2 * | 6/2016 | Miyoshi | H01R 24/60 |
| 9,385,481 | B2 * | 7/2016 | Chung | H01R 13/6581 |
| 9,397,438 | B2 * | 7/2016 | Chen | H01R 13/5219 |
| 9,437,956 | B2 * | 9/2016 | Fukami | B29C 70/72 |
| 9,437,957 | B2 * | 9/2016 | Lee | H01R 13/5202 |
| 9,553,410 | B2 * | 1/2017 | Zhao | H01R 13/6581 |
| 9,570,824 | B1 * | 2/2017 | Chien | H01R 12/7076 |
| 9,608,359 | B2 * | 3/2017 | Arai | H01R 12/716 |
| 9,620,904 | B2 * | 4/2017 | Kao | H01R 13/6581 |
| 9,634,425 | B1 * | 4/2017 | Hsu | H01R 13/5202 |
| 9,673,569 | B2 * | 6/2017 | Zhang | H01R 13/6585 |
| 9,742,098 | B2 * | 8/2017 | Zhao | H01R 13/5202 |
| 2014/0113497 | A1 * | 4/2014 | Wang | H01R 13/52 439/660 |
| 2016/0104957 | A1 * | 4/2016 | Kim | H01R 13/6581 439/78 |
| 2016/0126661 | A1 * | 5/2016 | Ma | H01R 13/521 439/676 |
| 2017/0155208 | A1 * | 6/2017 | Zhang | H01R 13/5216 |
| 2017/0207569 | A1 * | 7/2017 | Arai | H01R 13/5213 |

* cited by examiner

WATERPROOF ELECTRICAL CONNECTOR

BACKGROUND OF THE INVENTION

1. Field of the Invention

The present invention relates to a waterproof electrical connector.

2. Description of Related Art

China Patent Application Publication No. 204118373 discloses a reversible electrical connector. The electrical connector includes a main portion, a insulator, and a shell. The main portion includes a number of contacts and an insulator supporting the contacts. The insulator has a first groove located around thereof. The shell has at least one hole communicated with the first groove. Glue is flowed through the first groove to seal up the gap between the shell and the insulator and the hole. U.S. Patent Application Publication No. 9,088,092 discloses an electrical connector. The electrical connector includes an insulative housing, a number of contacts received into the insulative housing, a metallic shell enclosing the insulative housing, and a cover formed on a rear end of the insulative housing and the metallic shell. The contacts have a number of soldering portion extending rearwardly and beyond a rear surface of the insulative housing. The cover seals the rear surface of the insulative housing. However, this waterproof structure hardly seals up a rear end of the housing and the shell to flow fluid or gas to damage the electrical connector. Insulator formed by glue is too soft to ensure waterproof and control filter. Moreover, the cover preventing dust and lubricating oil are needed to prevent damage sometimes.

An improved electrical connector is desired.

SUMMARY OF THE INVENTION

Accordingly, the object of the present invention is to provide an electrical connector, comprising: an insulative housing; a plurality of terminals retained in the insulative housing, the terminals having a plurality of soldering portions extending out of a rear surface of the insulative housing; a shielding shell attached to the insulative housing, the shielding shell having a tail portion located at a rear end thereof; and an insulator insert-molded with a rear end of the shielding shell, the insulator at least wrapping partly an external surface of the tail portion to seal up a rear end of the insulative housing and extend the soldering portions of the terminals through the insulator to expose a rear surface thereof.

Other objects, advantages and novel features of the invention will become more apparent from the following detailed description when taken in conjunction with the accompanying drawings.

DETAILED DESCRIPTION OF THE PREFERRED EMBODIMENT

Figure 1:
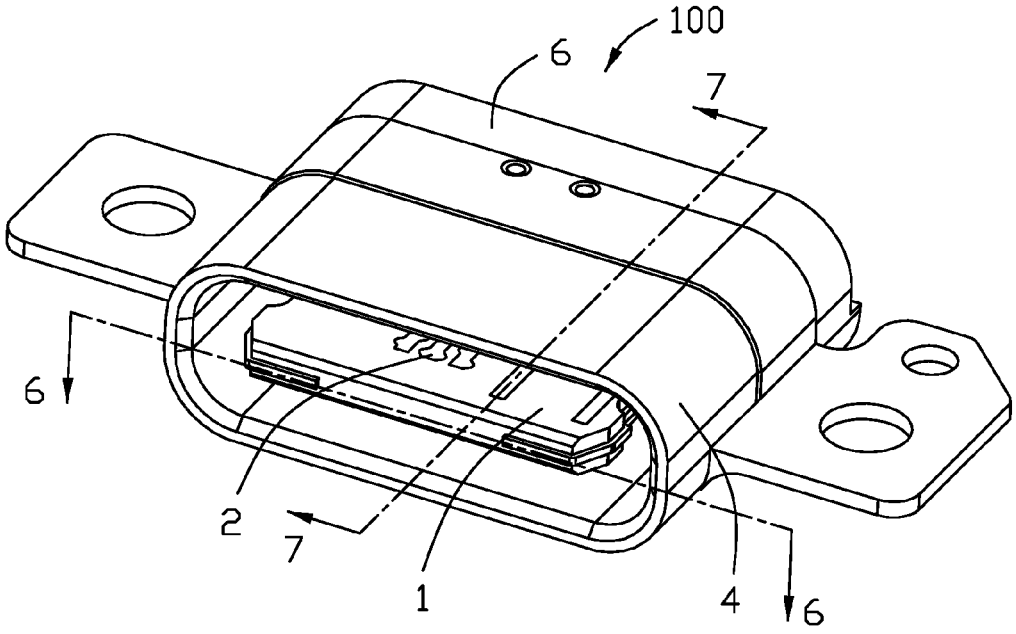
FIG. 1 is a perspective, assembled view of an electrical connector.

Reference will now be made in detail to the preferred embodiment of the present invention.

FIGS. 1 to 7 show an electrical connector 100 cooperated with a plug connector. For convenience, the electronic connector 100 defines a mating port, a mating direction, a transverse direction perpendicular to the mating direction and forming a horizontal plane therebetween, and a vertical direction perpendicular to the mating direction and the transverse direction in FIG. 1.

Referring to FIGS. 1-7, the electrical connector 100 includes an insulative housing 1, a number of terminals 2 and a metallic shielding plate 3 retained in the insulative housing 1, a shielding shell 4 encclosing the insulative housing, a collar 5 affixed to the insulative housing 1, and an insulator or glue 6 seals up a rear end of the shielding shell 4.

Figure 4:
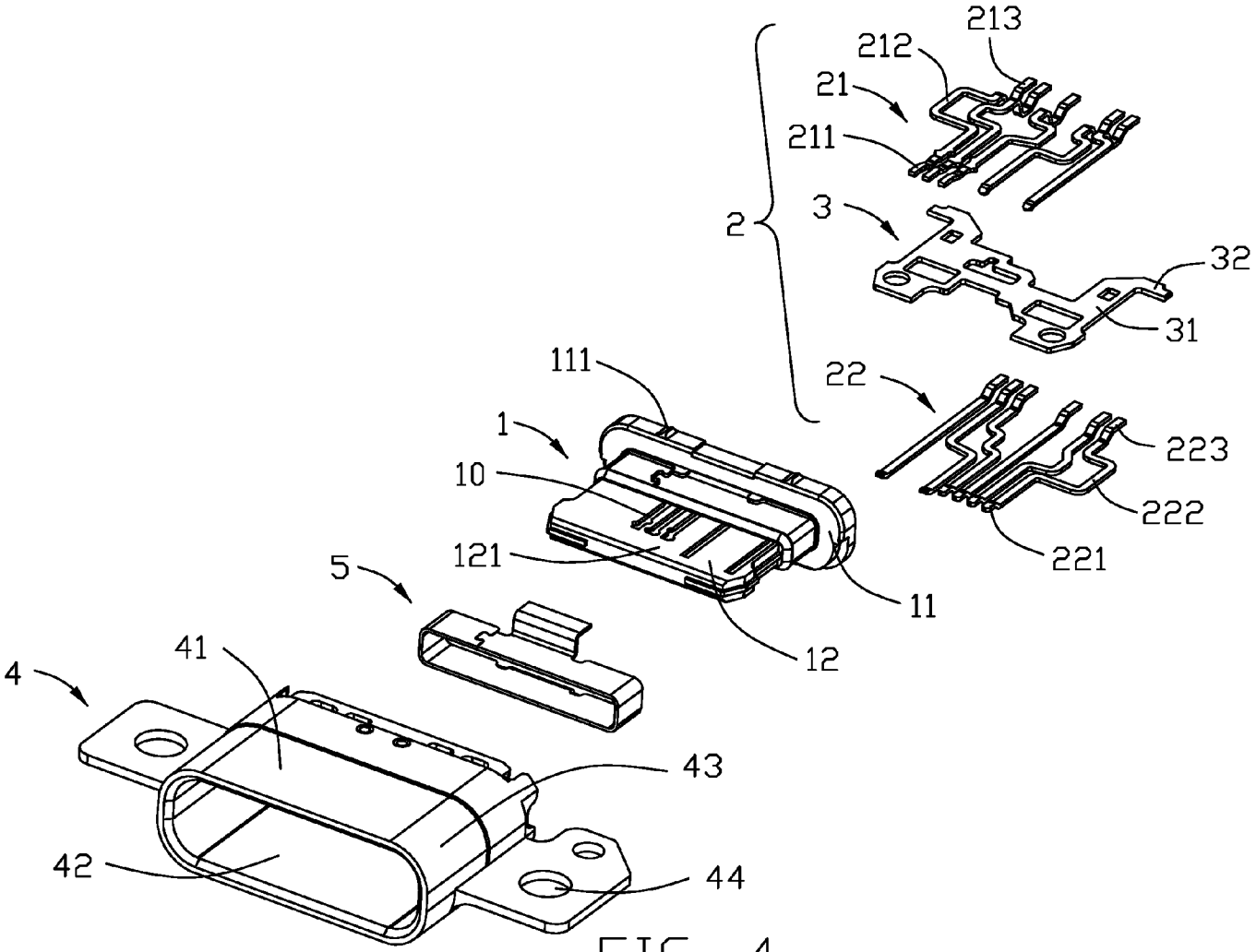
FIG. 4 is a perspective, exploded view of the electrical connector with no insulator.
Figure 5:
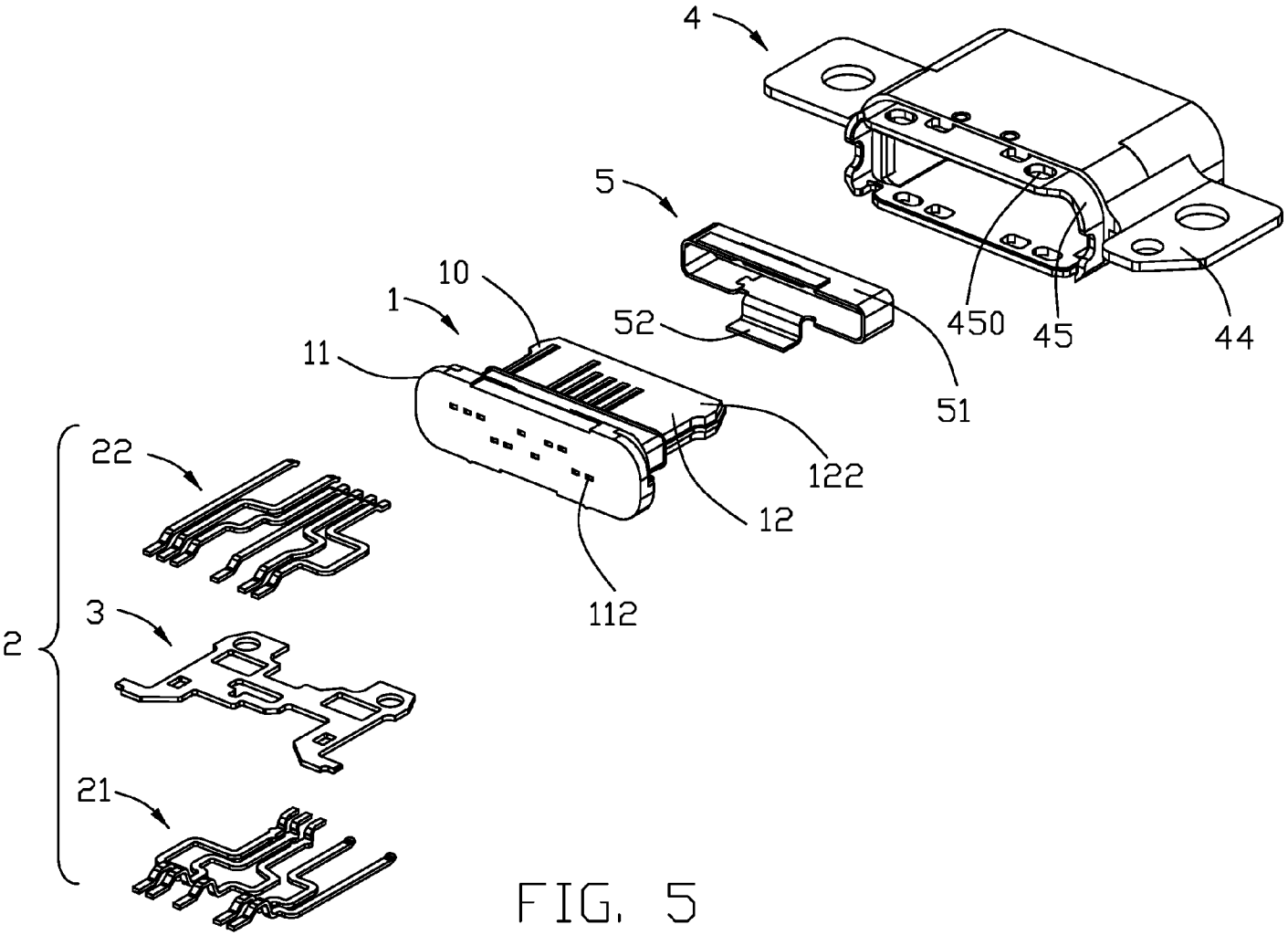
FIG. 5 is another perspective, exploded view of FIG. 4.
Figure 6:
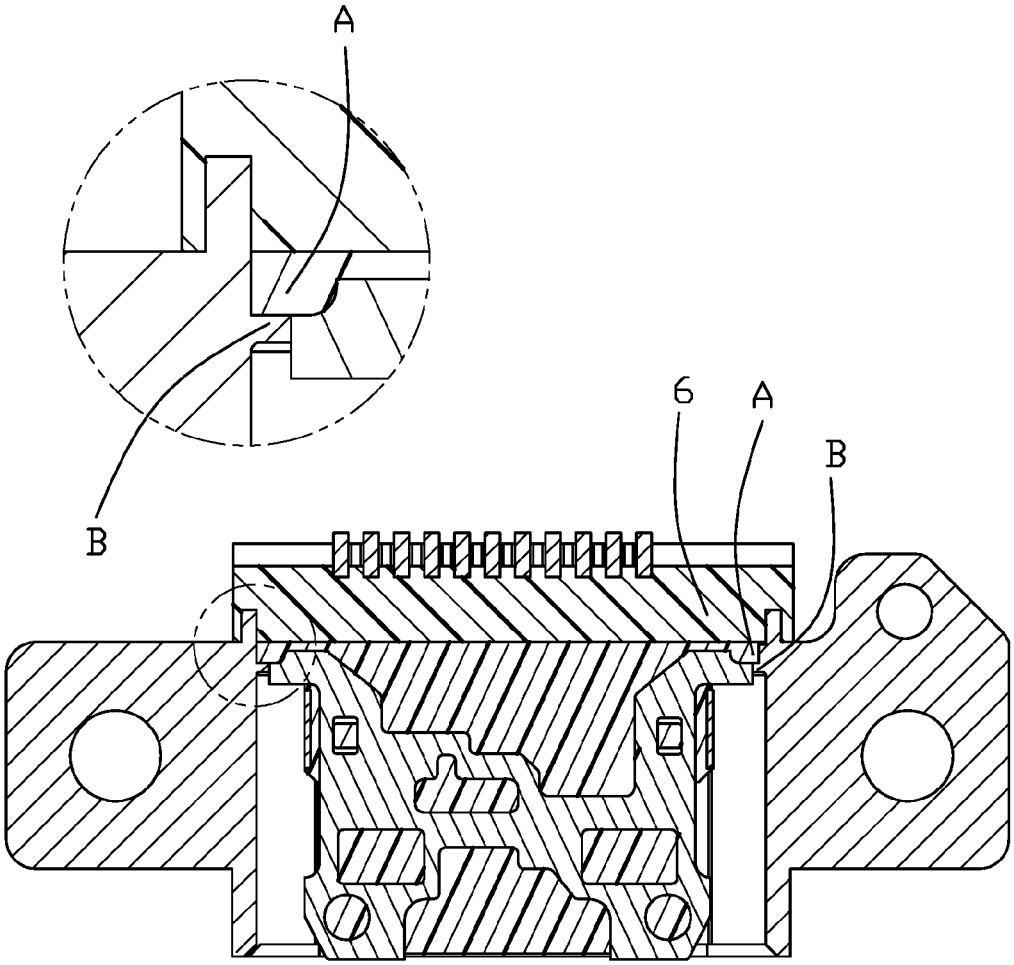
FIG. 6 is a cross-sectional view of the electrical connector of FIG. 1.
Figure 7:
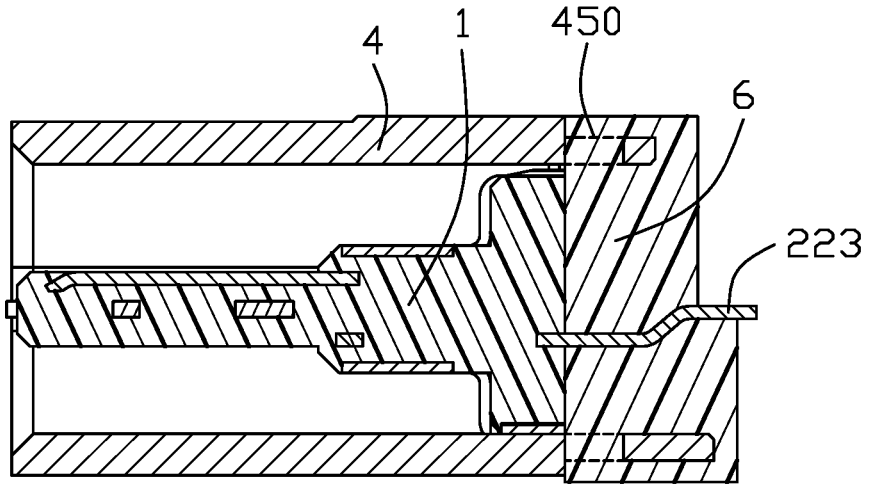
FIG. 7 is another cross-sectional view of the electrical connector of FIG. 1

Referring to FIGS. 4 to 5, the insulative housing 1 includes a base portion 11 and a tongue portion 12 extending forwardly from the base portion 11. The base portion 11 has a pair of ribs 111 located at an upper end and a number of holding slots 112 located at a rear surface thereof. The tongue portion 12 defines a first surface 121 and a second surface 122 disposed oppositely. The first surface 121 and the second surface 122 have a number of terminal-receiving slots 10 extending along the mating direction and communicated with the holding slots 112. The tongue portion 112 defines a pair of receiving portions to engage against latches of the meting connector.

Figure 3:
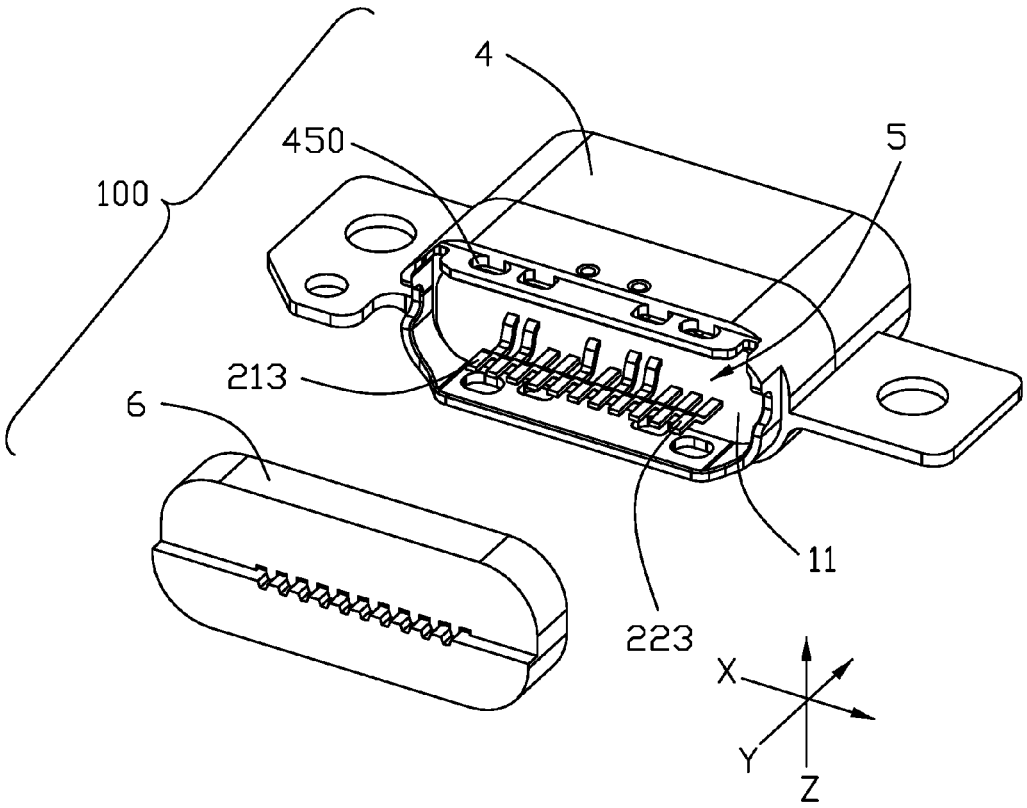
FIG. 3 is a perspective view of the electrical connector separated with a insulator.

Referring to FIGS. 3 to 5, the terminals 2 insert-molded with the insulative housing 1 to form a terminal module (not labeled), include a number of first contacts 21 and a number of second contacts 22. The first contacts 21 and the second contacts 22 are positioned to have 180 degree symmetry such that the corresponding plug connector can be inserted and operatively coupled to the electrical connector 100 in either of two orientations. Each of the first contacts 21 includes a first contacting portion 211 exposed from the first surface 121 and received in the terminal-receiving slots 10, a first connecting portion 212 retained in the base portion 11, and a first soldering portion 213 extending through the holding slot 112 and exposed from a rear surface of the insulative housing 1. Each of the second contacts 22 includes a second contacting portion 221 exposed from the second surface 122 and received in the terminal-receiving slots 10, a second connecting portion 222 retained in the base portion 11, and a second soldering portion 223 extending through the holding slot 112 and exposed from a rear surface of the insulative housing 1. The first contacts 21 and the second contacts 22 extending in an insertion direction. Each of the first contacts 21 is associated with a respective one of the second contacts 22 and is positioned in reverse symmetry with respect to the second contacts 22. The number of the first contacts 21 is five while the number of the second contacts 22 is six.

The metallic shielding plate 31 includes a supporting portion 31 and a side portion 32 extending laterally from rear sides of the supporting portion 32.

Referring to FIGS. 1 to 7, the shielding shell 4 is formed by die casting process of Kristie to attain a complex and high accuracy structure. The shielding shell 4 includes a top wall 41 and a bottom wall 42 located oppositely, and a pair of side walls 43 connected with the top wall 41 and the bottom wall 42. The side walls 43 respectively have a panel portion 44 affixed to a printed circuit board. Rear ends of the top wall 41, bottom wall 42, and the side walls 43 are formed with a tail portion 45 connected therewith. The tail portion 45 defines a thickness less than thicknesses of the top wall 41, bottom wall 42, and the side walls 43. The tail portion 45 has a number of grooves 450.

The collar 5 has a main portion 51 shaping like a cylinder and an affixed portion 52 bent upwardly and extending rearwardly from a rear end of the main portion 51. The main portion 51 encloses the tongue portion 12 and the affixed portion 52 is attached to the base portion 11.

Figure 2:
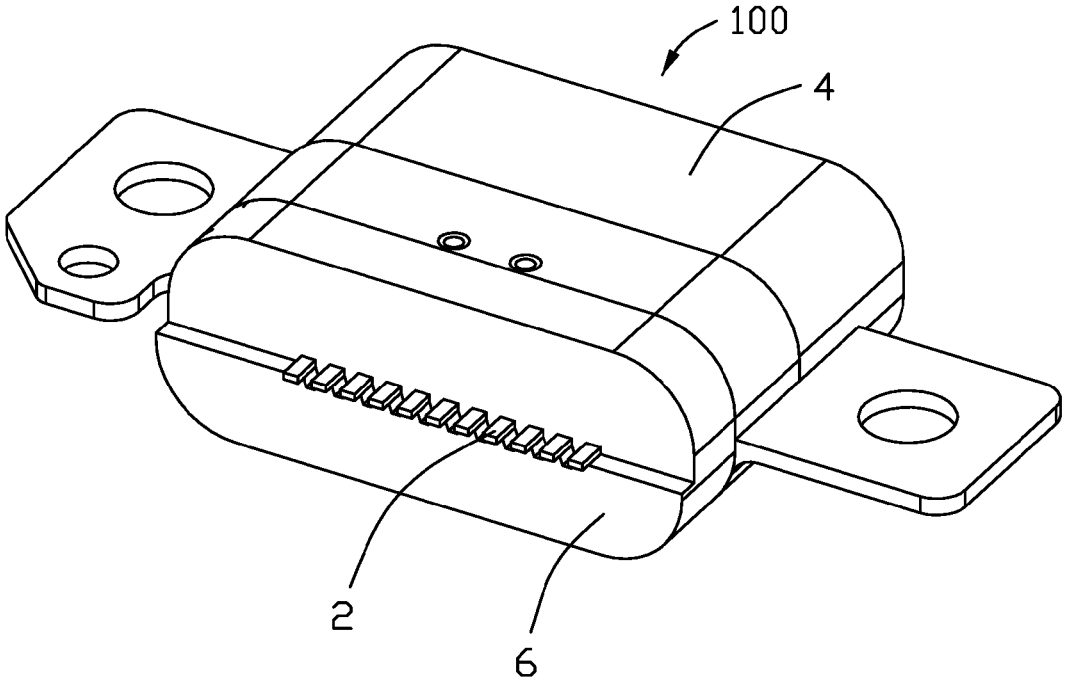
FIG. 2 is another perspective, assembled view of FIG. 1.

Referring to FIGS. 2 and 3, the insulator 6 is integrally formed with the shielding shell 4, the terminals 2, and the insulative housing 1 via an over-molding/insert-molding process. The insulator 6 fills the tail portion 45, a rear end of the base portion 11, and part of the first soldering portions 213 and second soldering portions 223 of the terminals 2 to align an outer surface of the insulator 6 with an outer surface of the top wall 41, the bottom wall 42, and the side walls 43. The first soldering portions 213 and second soldering portions 223 of the terminals 2 extends through the insulator 6 and exposed from a rear surface of the insulator 6. The first soldering portions 213 and second soldering portions 223 of the terminals 2 are defined as soldering portions. The insulator 6 covers an extending part of the top wall 41 and the bottom wall 42 in other embodiment.

The method of making the electrical connector 100 includes the steps of: providing a number of terminals 2 and a metallic shielding plate 3, insert-molding an insulative housing 1 with the terminals 2 and the metallic shielding plate 3 to form a terminal module (not labeled), the terminals 2 having a number of soldering portions extending out of a rear surface of the insulative housing 1; providing a tubular shielding shell 4 to enclose the insulative housing 1 (or the terminal module) to form a sub-assembly via forwardly inserting the terminal module into the shielding shell 4 with the shoulder A of the insulative housing 1 against the step B of the shielding shell 4 (FIG. 6) at the transverse ends along the transverse direction X wherein a receiving space S (FIG. 3) is formed behind the rear surface of the housing in the front-to-back direction Y perpendicular to the transverse direction X, the shielding shell 4 having a tail portion 45 located at a rear end and a number of grooves 450 located at the tail portion 45 to communicate with the receiving space S in a vertical direction Z perpendicular to the front-to-back direction Y; flowing synthetic resin through the grooves 450 and a rear end of the shielding shell 4 to form an insulator 6 insert-molded with the tail portion 45 of the shielding shell 4, (or in other words, applying the insulator 6 into the rear receiving space of the sub-assembly to over-mold both the insulative housing 1 and the shielding shell 4 for securing together), the insulator 6 at least wrapping partly an external surface of the tail portion 45 to seal up a rear end of the insulative housing 1 and extend the soldering portions of the terminals 2 through the insulator 6 to expose a rear surface thereof. It is noted that in this embodiment, the shielding shell 4 is made via a die-casting process so that the shielding shell 4 may have different thicknesses around the different portions thereof for efficiently resisting the external impact compared with the shielding shell made via stamping from sheet metal. Notably, the step B of the shielding shell 4 is located on the relative thicker portions of the shielding shell 4 compared with other portions.

However, the disclosure is illustrative only, changes may be made in detail, especially in matter of shape, size, and arrangement of sections within the principles of the invention.

What is claimed is:

1. An electrical connector, comprising:

an insulative housing;

a plurality of terminals retained in the insulative housing, the terminals having a plurality of soldering portions extending out of a rear surface of the insulative housing;

a shielding shell attached to the insulative housing, the shielding shell having a tail portion located at a rear end thereof; and an insulator insert-molded with a rear end of the shielding shell, the insulator at least wrapping partly an external surface of the tail portion to seal up a rear end of the insulative housing and extend the soldering portions of the terminals through the insulator so as to expose rear ends of the soldering portions of the terminals to an exterior; wherein the tail portion has a plurality of grooves filled by the insulator; and the shielding shell has a top wall and a bottom wall located oppositely, and a pair of side walls connected with the top wall and the bottom wall, and the tail portion has a thickness smaller than thicknesses of the top wall, the bottom wall and the side walls.

2. The electrical connector as claimed in claim 1, wherein an external surface of the insulator is aligned with external surfaces of the top wall, the bottom wall, and the side walls, and the insulator is located close to the insulative housing.

3. The electrical connector as claimed in claim 1, wherein said top wall, the bottom wall, and the side walls extend rearwardly to form the tail portion, and the insulator wraps the tail portion.

4. The electrical connector as claimed in claim 1, wherein the shielding shell is formed by die casting process.

5. An electrical connector comprising:

a terminal module including two rows of terminals with a metallic shielding plate therebetween in a vertical direction and commonly insert-molded within an insulative housing, the housing forming a front tongue portion with opposite surfaces on which front contacting sections of the terminals are exposed, and a rear surface through which rear soldering portions of the terminals extend rearwardly in a front-to-back direction;

a die-casting metallic tubular shielding shell receiving said terminal module therein to form a sub-assembly with a receiving space behind the rear surface of the housing; and an insulator received within the receiving space to integrally securing both said terminal module and the shielding shell; wherein the shielding shell includes a tail portion having at least one groove communicating with the receiving space in a direction perpendicular to the front-to-back direction;

the insulator is insert-molded with the tail portion of the shielding shell to at least wrap partly an external surface of the tail portion of the shielding shell.

6. The electrical connector as claimed in claim 5, wherein said housing includes a shoulder abutting forwardly against a step of the shielding shell in the front-to-back direction.

7. The electrical connector as claimed in claim 6, wherein said shielding shell forms different thicknesses on different portions thereof, and said step is located on the portion thicker than other portions of the shielding shell.

8. The electrical connector as claimed in claim 5, wherein the insulator fully surrounds and protectively hide the tail portion of the shielding shell from an exterior.

9. The electrical connector as claimed in claim 8, wherein the insulator protectively hides the at least one groove from an exterior.

10. The electrical connector as claimed in claim 8, wherein the insulator extends rearwardly beyond and protectively forwardly hides a rear end edge of the tail portion of the shielding shell from an exterior in the front-to-back direction.

11. The electrical connector as claimed in claim 5, wherein a step structure is formed on a rear face of the insulator in a side view to support the rear soldering portions of the terminals in the vertical direction.

12. A method of making an electrical connector, comprising the steps of:

providing a plurality of terminals and a metallic shielding plate;

insert-molding an insulative housing with the terminals and the metallic shielding plate to form a terminal module, the terminals having a plurality of soldering portions extending rearwardly out of a rear surface of the insulative housing along a front-to-back direction;

providing a metallic die-casting tubular shielding shell having different thicknesses on different portions thereof, to enclose the terminal module to commonly form a sub-assembly; and applying an insulator to said sub-assembly to cover said rear surface of the insulative housing with rear ends of the soldering portions extending rearwardly and exposed to an exterior by over-molding the terminal module and the shielding shell together; wherein the insulator protectively covers a tail portion of the shielding shell at least in a vertical direction perpendicular to the front-to-back direction.

13. The method as claimed in claim 12, wherein the terminal module is forwardly assembled into the shielding shell with a shoulder of the insulative housing forwardly abutting against a step of the shielding shell.

14. The method as claimed in claim 13, wherein said shoulder is located at a transverse end along a transverse direction perpendicular to the front-to-back direction.

15. The method as claimed in claim 13, wherein the step is located on a portion thicker than other portions of said shielding shell.

16. The method as claimed in claim 12, wherein the sub-assembly forms a receiving space behind the rear surface of the housing to receive said insulator, and said shielding shell includes a tail portion with a groove confronting the receiving space to receive a portion of the insulator therein for securing the terminal module and the shielding shell together.

17. The method as claimed in claim 16, wherein said groove communicates with the receiving space in a vertical direction perpendicular to said front-to-back direction to receive said portion of the insulator therein.

18. The method as claimed in claim 17, wherein said groove is hidden from an exterior by the insulator in the vertical direction.

19. The method as claimed in claim 12, wherein the insulator extends rearwardly beyond and protectively forwardly covers a rear end edge of the tail portion of the shielding shell in the front-to-back direction.

20. The method as claimed in claim 12, wherein a rear face of the insulator forms a step structure thereof to support the soldering portions thereon.

* * * * *